US012723768B2

(12) United States Patent
Choi et al.

(10) Patent No.: US 12,723,768 B2
(45) Date of Patent: Sep. 1, 2026

(54) HUMIDIFIER

(71) Applicant: LG ELECTRONICS INC., Seoul (KR)

(72) Inventors: Chiyoung Choi, Seoul (KR); Jaeheuk Choi, Seoul (KR); Dongryul Park, Seoul (KR); Yongmin Kim, Seoul (KR); Jeonghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 338 days.

(21) Appl. No.: 18/537,492

(22) Filed: Dec. 12, 2023

(65) Prior Publication Data

US 2024/0200806 A1 Jun. 20, 2024

(30) Foreign Application Priority Data

Dec. 19, 2022 (KR) ..... 10-2022-0177799

(51) Int. Cl.
*F24F 6/12* (2006.01)
*F24F 13/08* (2006.01)
*F24F 6/00* (2006.01)

(52) U.S. Cl.
CPC ..... *F24F 6/12* (2013.01); *F24F 13/082* (2013.01); *F24F 2006/008* (2013.01)

(58) Field of Classification Search
CPC ..... F24F 6/12; F24F 13/082
See application file for complete search history.

(56) References Cited

U.S. PATENT DOCUMENTS 10,304,324 B2 * 5/2019 Smith ..... F04D 25/08

FOREIGN PATENT DOCUMENTS

| | | | |
|---|---|---|---|
| CN | 211600985 | | 9/2020 |
| CN | 211600985 U | * | 9/2020 |
| EP | 3907437 | | 11/2021 |
| JP | 2012-042161 | | 3/2012 |
| KR | 10-2016-0025979 | | 3/2016 |
| KR | 10-1717187 | | 3/2017 |
| KR | 10-2018-0065355 | | 6/2018 |
| KR | 10-2200385 | | 1/2021 |

OTHER PUBLICATIONS

European Search Report dated May 23, 2024 issued in Application No. 23217849.1.

* cited by examiner

*Primary Examiner* — Robert A Hopkins
(74) *Attorney, Agent, or Firm* — KED & ASSOCIATES, LLP

(57) ABSTRACT

The present disclosure relates to a humidifier. A humidifier of the present disclosure includes: a humidification unit for generating mist; a flow path body disposed above the humidification unit, that has a discharge flow path having an annular cross-section through which mist released from the humidification unit flows; and a plurality of guide vanes disposed on the discharge flow path, slanted from the vertical, wherein the plurality of guide vanes may be spaced apart from each other along the periphery of the discharge flow path.

16 Claims, 8 Drawing Sheets

HUMIDIFIER

CROSS-REFERENCE TO RELATED PATENT APPLICATIONS

This application claims priority to Korean Patent Application No. 10-2022-0177799, filed Dec. 19, 2022, whose entire disclosures are hereby incorporated by reference.

BACKGROUND

Field

A humidifier, more particularly, to a humidifier that discharges uniformly humidified air.

Related Art

A humidifier is an appliance that releases humidified air containing large amounts of moisture by vaporizing water. The humidifier is able to create humidified air by vaporizing water by natural evaporation, evaporation by heating, ultrasonic vibration, etc.

The "humidifier" disclosed in Korean Patent Registration No. 2200385 includes: a housing; a tray disposed inside the housing, for storing water; and a humidification assembly for atomizing the water stored in the tray, wherein the housing has a discharge opening with an annular open top through which mist is discharged.

The above conventional humidifier may have an annular discharge opening at the top of the housing, for discharging mist. A problem with this humidifier is that the humidification assembly is not able to produce mist uniformly in all directions, and that, as a result, the mist cannot be discharged uniformly in all directions through the annular discharge opening.

Another problem is that, if the humidification assembly is placed off to one side of the center of the annular discharge opening, the mist produced in the humidification assembly is discharged off to one side of the annular discharge opening.

PRIOR ART DOCUMENTS

Patent Document

Korean Patent Registration Publication No. 10-2200385 B1 (filed on Jan. 8, 2021).

SUMMARY

The present disclosure is directed to providing a humidifier capable of uniformly humidifying an indoor space.

Another aspect of the present disclosure is to provide a humidifier that discharges mist uniformly in all directions.

Yet another aspect of the present disclosure is to provide a humidifier that reduces discomfort in use.

A further aspect of the present disclosure is to provide a humidifier that carries humidified air over long distances.

The aspects of the present disclosure are not limited to the foregoing, and other aspects not mentioned herein will be able to be clearly understood by those skilled in the art from the following description.

To accomplish the foregoing aspects, an exemplary embodiment of the present disclosure provides a humidifier comprising: a humidification unit for generating mist; a flow path body disposed above the humidification unit, that has a discharge flow path having an annular cross-section through which mist released from the humidification unit flows; and a plurality of guide vanes disposed on the discharge flow path, slanted from the vertical, wherein the plurality of guide vanes may be spaced apart from each other along the periphery of the discharge flow path.

The humidification unit may have an outlet through which generated mist is released, wherein the outlet may be placed off to one side of the center of the discharge flow path.

The flow path body may comprise: a tank with an open top, for storing water; and a shell spaced outward from the outer periphery of the tank, wherein the discharge flow path may be formed between the tank and the shell and communicate with the outlet.

The shell may include: an inner shell spaced outward from the outer periphery of the tank; and an outer shell spaced outward from the outer periphery of the inner shell, the discharge flow path may include: an inner discharge flow path formed between the tank and the inner shell; and an outer discharge flow path formed between the inner shell and the outer shell, the outlet may communicate with the inner discharge flow path, and the plurality of guide vanes may include a plurality of inner guide vanes disposed on the inner discharge flow path.

The plurality of guide vanes may be formed to project upward, whereby ascending humidified air may change the direction of flow to diagonal as it passes through the guide vanes.

The plurality of guide vanes may include: a front end through which ascending mist is admitted; and a rear end through which ascending mist is discharged, wherein the angle at which the rear end is slanted from the vertical may be larger than the angle at which the front end is slanted from the vertical. Thus, humidified air may be smoothly admitted to a flow path between the plurality of guide vanes, and the plurality of guide vanes may allow the humidified air to rise as it swirls around the periphery of the discharge flow path.

The humidifier may further comprise an annular discharge grille disposed on the discharge flow path and having a plurality of discharge vanes, wherein the plurality of discharge vanes may be spaced apart from each other along the periphery of the discharge grille, and a discharge opening communicating with the discharge flow path may be formed between the plurality of discharge vanes.

The discharge grille may be spaced upward from the plurality of guide vanes, thereby controlling the direction of flow of a spirally ascending airstream that has passed through the guide vanes.

The plurality of discharge vanes may extend vertically, whereby a spirally ascending airstream that has passed through the guide vanes may change the direction of flow so that it becomes a linearly ascending airstream.

The flow path body may include: a tank with an open top, for storing water; a tank holder into which the tank is inserted, and which covers the outer periphery of the tank; and a shell spaced outward from the outer periphery of the tank holder, wherein the discharge flow path may be formed between the tank holder and the shell, and the tank holder may have a holder rib protruding outward from the outer periphery and spaced inward from the inner periphery of the shell, thereby controlling the area of the discharge flow path.

The distance between the holder rib and the shell may become smaller toward the outlet. Thus, mist released from the outlet may be distributed, from one side to which the outlet is placed off to the other side.

An exemplary embodiment of the present disclosure provides a humidifier including: a humidification unit for generating mist; a flow path body disposed above the humidification unit, that has a discharge flow path having an annular cross-section through which mist released from the humidification unit flows; and a plurality of guide vanes disposed on the discharge flow path, for guiding mist, wherein the plurality of guide vanes may be spaced apart from each other along the periphery of the discharge flow path, and an inlet angle at which ascending mist is admitted to the plurality of guide vanes may be smaller than an outlet angle at which mist is discharged from the plurality of guide vanes.

Specific details of other embodiments are included in the detailed description and the drawings.

According to at least one of the embodiments of the present disclosure, a plurality of guide vanes are disposed at a slant on a discharge flow path, which allows mist and an ascending airstream to be uniformly mixed together as humidified air swirls in spirals.

According to at least one of the embodiments of the present disclosure, the formation of an annular discharge opening makes it possible for humidified air uniformly mixed by the plurality of guide vanes to be uniformly distributed in all directions.

According to at least one of the embodiments of the present disclosure, the plurality of guide vanes, which are formed to project upward, may facilitate the swirling motion of ascending humidified air.

The effects of the present disclosure are not limited to the foregoing, and other effects not mentioned herein will be able to be clearly understood by those skilled in the art from the following description.

DESCRIPTION OF EXEMPLARY EMBODIMENTS

Figure 1:
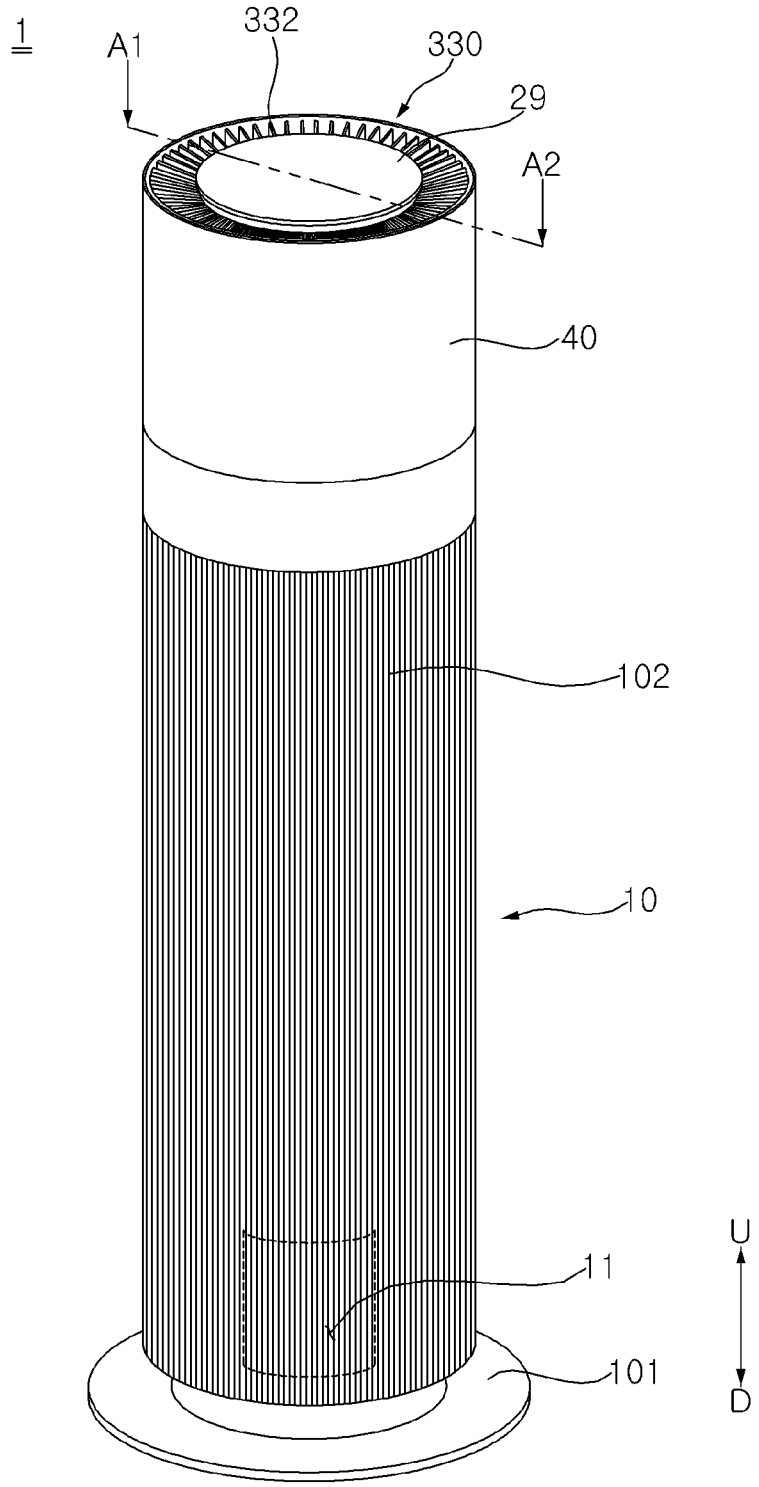
FIG. 1 is a perspective view of a humidifier according to an embodiment of the present disclosure.

Hereinafter, the embodiments disclosed in the present specification will be described in detail with reference to the accompanying drawings. The same or similar elements will be assigned the same reference numerals irrespective of the reference numerals, and redundant descriptions thereof will be omitted.

The suffixes "module", "unit", "part", and "portion" used to describe constituent elements in the following description are used together or interchangeably to facilitate the description, but the suffixes themselves do not have distinguishable meanings or functions.

In describing the embodiments disclosed in the present specification, a detailed description of a related known technology will be omitted when it is deemed that it may unnecessarily obscure the subject matter of the present disclosure. Also, it should be understood that the appended drawings are intended only to help understand the embodiments disclosed in the present specification and do not limit the technical idea disclosed in the present disclosure; rather, it should be understood that all changes, equivalents, and substitutions included in the technical scope and spirit of the present disclosure are included.

Terms such as 'first', 'second', etc., may be used to describe various components, but the components are not to be construed as being limited to the terms. The terms are used only to distinguish one component from another component.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween.

The singular expressions may include plural expressions unless the context clearly dictates otherwise.

A humidifier 1 will be described with reference to FIG. 1.

The humidifier 1 includes a humidification unit 10 that generates mist from water. The humidification unit 10 may be supplied with water from a tray storing water. The tray may be a tank 20 (see FIG. 2).

The humidification unit 10 may discharge air containing mist. The mist may include an aerosol of water droplets and steam. The humidification unit 10 may generate mist by natural by natural evaporation, evaporation by heating, ultrasonic vibration. For example, the humidification unit 10 may be an ultrasonic vibration-type with a diaphragm 272 (see FIG. 3).

Mist may be emitted through an outlet 290 (FIG. 3) of the humidification unit.

The humidifier 1 may have an intake opening 11 for drawing in air. The intake opening 11 may be formed on a peripheral wall of the humidification unit. For example, the intake opening 11 may be formed through a lower part of a peripheral wall of the humidification unit 10.

The humidifier 1 may include a louver 102 along a periphery of the humidification unit 10. A plurality of louvers 102 may be disposed along the outer periphery of the humidification unit 10. The louver 102 may cover the intake opening 11. The louver 102 may prevent foreign matter from getting into the intake opening 11. The louver 102 may prevent the user's body from being caught in the intake opening 11.

The humidifier 1 may include a base 101 that supports the humidifier 1. The base 101 may distribute the load of the humidification unit 10 throughout its bottom surface. The base 101 may protrude horizontally outward from the humidification unit 10. The outer periphery of the base 101 may be positioned horizontally outward from the outer periphery of the humidification unit 10. The base 101 may have a larger cross-sectional area than the humidification unit 10. For example, the base 101 may have larger cross-sectional diameter than the humidification unit 10.

Thus, the base is able to prevent overturning or tilting of the humidifier.

The humidifier 1 includes a flow path body (not indicated by a reference numeral) with a discharge flow path 117 and 310 (see FIG. 3) in which mist generated in the humidification unit 10 moves. The flow path body may be disposed in an upper part of the humidification unit 10. The mist generated in the humidification unit 10 may ascend through the discharge flow path formed in the flow path body.

The flow path body may include at least one of a shell 40, a tank 20, a tank holder 30, and a sub guide 50 which will be described later. For example, the flow path body may include an inner shell 41 and a tank holder 30, and an inner discharge flow path 310 may be formed between the inner shell 41 and the tank holder 30. Further, the flow path body may include the inner shell 41 and an outer shell 42, and an outer discharge flow path 117 may be formed between the outer shell 42 and the inner shell 41.

The humidifier 1 includes a shell 40 for guiding mist. The flow path body may include the shell 40. The shell 40 may form the exterior of the flow path body. The shell 40 may guide mist generated in the humidification unit 10. The shell 40 is disposed above the humidification unit 10. The shell 40 may internally have a space in which mist moves. For example, the shell 40 may have the shape of a cylinder with an internal space.

The humidifier 1 may include a discharge grille 330 for guiding a discharge flow of air. The discharge grille 330 may be disposed at one end of the discharge flow path 117 and 310. The one end of the discharge grille 117 and 310 may be the discharge opening 320. For example, the discharge opening 320 may be formed at an upper end of the discharge flow path 117 and 310, and the discharge grille 330 may be disposed at the discharge opening 320. For example, the humidifier 1 may include an annular discharge grille 330 disposed at an annular discharge opening 320.

The discharge opening 320 may be formed at the top of the humidifier 1.

The discharge grille 330 may guide at least one of air and mist discharged through the discharge opening 320. The discharge grille 330 may determine the direction in which a fluid to be discharged is discharged.

The discharge grille 330 may correspond in shape to the discharge opening 320. For example, the discharge opening 320 may have an annular shape, and the discharge grille 330 may have an annular shape corresponding to the shape of the discharge opening 320.

The discharge grille 330 may be fastened to an upper end of the shell 40. An outer peripheral edge of the discharge grille 330 may correspond to the inner periphery of the upper end of the shell 40.

The discharge grille 330 may include a plurality of discharge vanes 332 for guiding humidified air. The plurality of discharge vanes 332 may be disposed at the discharge opening 320. For example, the plurality of discharge vanes 332 may be radially disposed, spaced apart from each other along the annular discharge opening 320.

A tank cap 29 may be attached to or detached from the discharge grille 330. The tank cap 29 may be fastened to an inner peripheral edge of the discharge grille 330, or may be removed from the inner peripheral edge of the discharge grille 330. An outer peripheral edge of the tank cap 29 may correspond to the inner peripheral edge of the discharge grille 330. For example, the discharge grille 330 may be annular, the tank cap 29 may be circular, and the tank cap 29 may be attached to or detached from the inner peripheral edge of the discharge grille 330.

Figure 2:
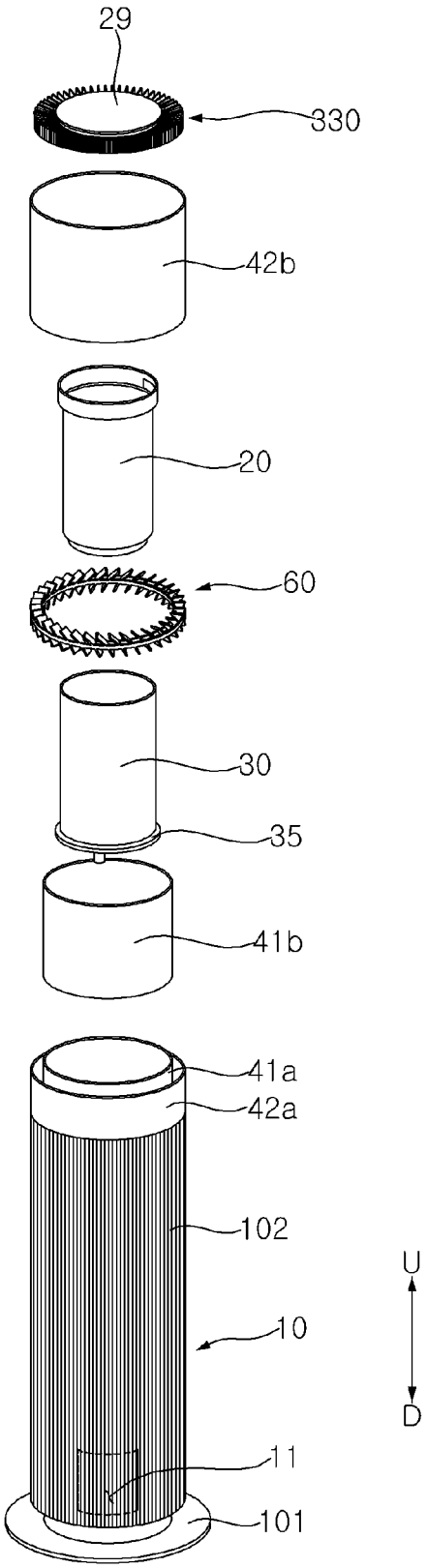
FIG. 2 an exploded assembly diagram of a humidified according to an embodiment of the present disclosure.

Referring to FIG. 2, the humidifier 1 will be described.

The shell 40 may include an outer shell 42. The shell 40 may include an inner shell 41 disposed inside the outer shell 42.

The outer periphery of the outer shell 42 may be longer than the outer periphery of the inner shell 41. The outer periphery of the outer shell 42 may be positioned horizontally outward from the outer periphery of the inner shell 41. An inner side of the outer shell 42 may face the outer periphery of the inner shell 41.

The outer shell 42 may include an upper outer shell 42*b* and a lower outer shell 42*a*. The upper outer shell 42*b* may be fastened to an upper end of the lower outer shell 42*a*. The upper outer shell 42*b* may be fastened to the upper end of the lower outer shell 42*a* by being turned in a first direction, and may be removed by being turned in a second direction. The second direction may be the reverse of the first direction. For example, the first direction may be clockwise, and the second direction may be counterclockwise.

The lower outer shell 42*a* may be made transparent. The lower inner shell 41*a* may be made transparent. The user can visually see mist moving through the transparent lower outer shell 42*a* and lower inner shell 41*a*.

A tank holder 30 may be disposed inside the inner shell 41. The outer periphery of the inner shell 41 may be longer than the outer periphery of the tank holder 30. The outer periphery of the inner shell 41 may be positioned horizontally outward from the outer periphery of the tank holder 30. The inner shell 41 may cover the outer periphery of the tank holder 30. An inner side of the inner shell 41 may face the outer periphery of the tank holder 30.

The inner shell 41 may include an upper inner shell 41*b* and a lower inner shell 41*a*. The upper inner shell 41*b* may be fastened to an upper end of the lower inner shell 41*a*. The upper inner shell 41*b* may be fastened to the upper end of the lower inner shell 41*a* by being turned in a first direction, and may be removed from it by being turned in a second direction. The second direction may be the reverse of the first direction. For example, the first direction may be clockwise, and the second direction may be counterclockwise.

The humidifier 1 includes a tank 20 for storing water. The tank 20 may extend vertically. The tank 20 may have an internal space where water is stored.

The tank 20 may be disposed above the humidification unit 10. The tank 20 may supply the stored water to the humidification unit 10. The tank 20 may be disposed inside the flow path body. For example, the tank 20 may be disposed at the center of the inside of the inner shell 41.

The tank 20 may be placed in the tank holder 30. The tank holder 30 may cover the outer periphery of the tank 20. The tank 20 may be vertically inserted into or taken out from a tank holder 30 with an open top. For example, the user may pull the tank 20 upward and take it out from the tank holder 30, and may push and insert the tank 20 downward into the open top of the tank holder 30.

The tank 20 may be open at the top. For example, the internal space of the tank 20 where water is stored may be cylindrical, and the top of the tank 20 may be open.

Thus, the user may feed water immediately to the open top of the tank, without removing the tank from the tank holder.

The humidifier 1 may include a tank cap 29 that covers the open top of the tank 20. The tank cap 29 may be disposed above the tank 20. The tank cap 29 may be tightened around an upper end of the tank 20.

This keeps foreign matter from getting into the tank.

Moreover, the water stored in the tank can be prevented from being contaminated.

This also helps keep the water stored in the tank from flowing out of the open top.

The humidifier 1 includes a tank holder 30 in which the tank 20 is inserted. The tank holder 30 is disposed above the humidification unit 10. The tank holder 30 may be disposed inside the shell 40. The tank holder 30 may be spaced inward from an inner surface of the shell 40. For example, the outer periphery of the tank holder 30 may be positioned horizontally inward from the outer periphery of the shell 40. The radius of the tank holder 30 may be smaller than the radius of the shell 40.

The shell 40 may cover the outer periphery of the tank holder 30. For example, the inner shell 41 may cover the outer periphery of the tank holder 30.

The tank holder 30 may be open at the top, and the tank 20 may be inserted or taken out through the open top of the tank holder 30.

The tank holder 30 may cover the outer periphery of the tank 20. The tank holder 30 may fix the tank 20. For example, the tank holder 30 may keep the tank 20 from moving laterally.

With the tank holder 30 covering the tank 20, the amount of condensate forming on the outer periphery of the tank 20 may collect into the tank holder 30.

This helps prevent water falling from the tank in the process of attaching or detaching the tank.

Moreover, this can keep the humidifier in a pleasant and clean environment.

In addition, the user's convenience and safety can be enhanced.

The tank holder 30 may have a space where the tank 20 is inserted. A peripheral wall of the tank holder 30 may correspond to a peripheral wall of the tank. The peripheral length of the peripheral wall of the tank 20 may correspond to the peripheral length of the peripheral wall of the tank holder 30. The outer periphery of the peripheral wall of the tank 20 may correspond to the inner periphery of the peripheral wall of the tank holder 30 or smaller than the inner periphery of the peripheral wall of the tank holder 30.

The peripheral wall of the tank holder 30 may fix the peripheral wall of the tank 20. The peripheral wall of the tank holder 30 may support the peripheral wall of the tank 20. The tank holder 30 may keep the tank 20 from shifting laterally. The peripheral wall of the tank holder 30 and the peripheral wall of the tank 20 may be close to each other. The distance between the peripheral wall of the tank holder 30 and the peripheral wall of the tank 20 may be minimized.

Thus, the amount of condensation forming on the outer periphery of the tank can be reduced.

Moreover, the lateral play in the tank can be minimized.

In addition, vibration and noise generated during operation of the humidifier can be reduced.

Furthermore, this helps reduce condensation on the outer periphery of the tank.

The tank holder 30 may include a holder rib 35 protruding outward from the peripheral wall. The holder rib 35 may extend along the peripheral wall of the tank holder 30. The holder rib 35 may be formed in a circular or elliptical shape. The length the holder rib 35 protrudes may change along the periphery of the tank holder 30. For example, the holder rib 35 may protrude horizontally outward from the underside of the peripheral wall of the tank holder 30, and may extend along the periphery of the peripheral wall of the tank holder 30.

The outer periphery of the holder rib 35 may be larger than the outer periphery of the peripheral wall of the tank holder 30. The outer periphery of the holder rib 35 may be smaller than the inner periphery of the shell 40. For example, the outer periphery of the holder rib 35 may be smaller than the inner periphery of the inner shell 41.

The holder rib 35 may be spaced inward from an inner side of the shell 40. A gap may be created between the holder rib 35 and the inner side of the shell 40. The gap between the holder rib 35 and the inner side of the shell 40 may change along the periphery of the holder rib 35.

The holder rib 35 may be positioned on the underside of the peripheral wall of the tank holder 30.

The holder rib 35 may have a flat top surface.

The humidifier 1 may include a guide grille 60 disposed on the discharge flow path. The guide grille 60 may be disposed inside the inner shell 41. The guide grille 60 may be disposed along the inner periphery of the inner shell 41. The guide grille 60 may be disposed between the inner shell 41 and the tank 20. The guide grille 60 may be disposed between the inner shell 41 and the tank holder 30. By disposing the guide grille 60 on the discharge flow path, humidified air ascending through the discharge flow path may move in a spiral manner.

Figure 3:
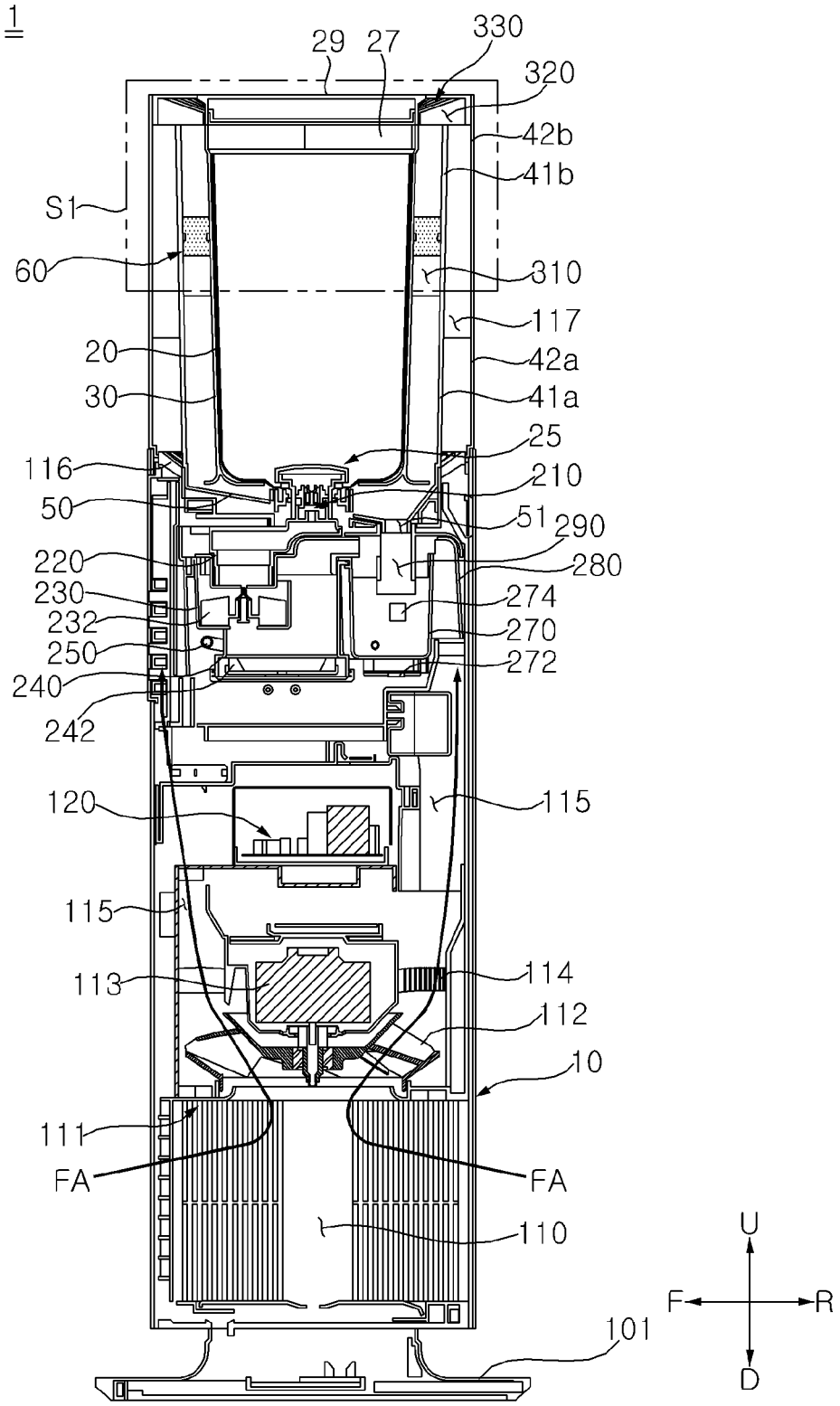
FIG. 3 is a cutaway cross sectional view of the humidifier taken along the line A1-A2 in FIG. 1.

Referring to FIG. 3, the humidifier 1 will be described.

The humidifier 1 may have an intake opening 11 for drawing in air. Air admitted through the intake opening 11 may pass through an intake flow path 110 and move upward along a flow path formed in the humidification unit 10.

The humidifier 1 may include a filter for purifying air. The filter may face the intake opening 11. The filter may be disposed in the humidification unit 10. The filter may be disposed between the intake opening 11 and the intake flow path 110 and purify the air admitted through the intake opening 11.

Thus, the air purification performance of the humidifier can be improved.

The humidification unit 10 may include a blower fan 112 that forms an airstream from the intake opening 11 to the discharge opening 320. The blower fan 112 may be positioned above the intake flow path 110. The blower fan 112 may cause air to move upward.

The humidification unit 10 may include a blower motor 113 for rotating the blower fan 112.

The humidification unit 10 may include an air guide 114 for guiding air that has passed through the blower fan 112. The air guide 114 may be spaced outward from the blower motor 113.

A plurality of air guides 114 may be provided. The plurality of air guides 114 may be disposed radially from the axis of the blower fan 112. The air guide 114 may be positioned on a blower flow path 115. The air guide 114 may linearize the movement of air blown from the blower fan 112. For example, the air guide 114 may guide the air blown from the blower fan 112 to move upward.

The air that has passed through the blower fan 112 may move along the blower flow path 115. The blower flow path 115 may extend vertically along the inner periphery of the humidification unit 10. For example, the humidification unit 10 may have a cylindrical outward appearance, and a cross-section of the blower flow path 115 may be annular along the inner periphery of the humidification unit 10.

The air that has passed through the blower flow path 115 may move upward and reach a space between the tank holder 30 and the shell 40. The air that has passed through the blower flow path 115 may be released along with mist. The air that has passed through the blower flow path 115 may be released separately from mist. Part of the air that has passed through the blower flow path 115 may be released along with mist, and the rest may be released separately from mist.

When part of the air that has passed through the blower flow path 115 may be released along with mist, it may enter a humidification reservoir 270 through a bypass pipe 280. Part of the air moving upward through the blower flow path 115 may enter the bypass pipe 280, and the rest may move to an outer discharge flow path 117.

The air admitted to the bypass pipe 280 may move upward along with mist and then flow to an inner discharge flow path 310 and be discharged.

The bypass pipe 280 may be disposed between the inner periphery of the humidification unit 10 and the humidification reservoir 270. The bypass pipe 280 may be disposed on one side of the blower flow path 115. As part of the air moving along the blower flow path 115 is supplied to the humidification reservoir 270 through the bypass pipe 280, the rest of the air that has passed through the blower flow path 115 may not flow uniformly through the outer discharge flow path 117 which communicates to the blower flow path 115.

The inner discharge flow path 310 may be formed between the tank holder 30 and the shell 40. The inner discharge flow path 310 may be formed between the tank holder 30 and the inner shell 41. Thus, air and mist may move along the outer periphery of the tank holder 30.

The inner shell 41 may divide the discharge flow path 117 and 310. The discharge flow path 117 and 310 may include an inner discharge flow path 310 on the inside and an outer discharge flow path 117 on the outside. For example, the discharge flow path 117 and 310 which has an annular cross-section may include an inner discharge flow path 310 having an annular cross-section and positioned on the inside and an outer discharge flow path 117 having an annular cross-section and positioned on the outside. For example, the inner shell 41 may divide the discharge flow path 117 and 310 into an inner discharge flow path 310 on the inside and an outer discharge flow path 117 on the outside.

The inner discharge flow path 310 and the outer discharge flow path 117 may be joined together at the top of the inner shell 41. For example, the inner discharge flow path 310 and the outer discharge flow path 117 may be joined together at an upper end of the inner shell 41.

Part of the air that has passed through the blower flow path 115 may enter the bypass pipe 280 and exit to the outlet 290 along with mist generated in the humidification reservoir 270. Part of the air that has passed through the blower flow path 115 and the air containing mist generated in the humidification reservoir 270 may be referred to as humidified air. The humidified air released from the outlet 290 may ascend through the inner discharge flow path 310.

The humidifier 1 may include a sub guide 50 for guiding mist released from the humidification unit 10. The sub guide 50 may guide the mist and/or air released from the outlet 290 to the inner discharge flow path 310.

The sub guide 50 may be disposed above the humidification reservoir 270. The sub guide 50 may be connected to the outlet 290. The sub guide 50 may be disposed below the tank holder 30. The sub guide 50 may be spaced downward from the tank holder 30. The mist released from the outlet 290 may move to a space between the sub guide 50 and the tank holder 30.

The sub guide 50 may be connected to the shell 40. The sub guide 50 may be connected to the peripheral wall of the shell 40. The mist released from the outlet 290 may be guided to the inner side of the shell 40 by the sub guide 50.

The mist that has passed through the sub guide 50 may move along the discharge flow path 310 formed between the shell 40 and the tank holder 30. The shell 40 and/or the tank holder 30 may guide the movement of ascending mist.

The mist that has passed through the discharge flow path 310 may be discharged through the discharge opening 320 positioned at an upper end of the discharge flow path 310.

The sub guide 50 may have a sub inlet 51 into which mist generated from the humidification unit 10 is admitted. The sub inlet opening 51 may correspond to the outlet 290 through which the mist from the humidification unit 10 is released. The sub inlet 51 may be connected to the outlet 290 through which the mist from the humidification unit 10 is ejected. The sub inlet 51 may be inserted into the outlet 290 of the humidification unit 10. Contrariwise, the outlet 290 of the humidification unit 10 may be inserted into the sun inlet 51.

The sub inlet 51 may be formed at the bottom of the sub guide 50. The sub inlet 51 may penetrate the sub guide 50. The sub inlet 51 may be a pass-through opening that is formed through the sub guide 50. The sub inlet 51 may extend vertically. For example, the sub inlet 51 may be a pass-through opening that is formed through the sub guide 50 and extends vertically, and the sub inlet 51 may be inserted into the outlet 290 of the humidification unit 10. The sub inlet 51 may have the shape of a cylinder that extends downward from the sub guide 50.

The sub inlet 51 may be formed at the bottom of the sub guide 50, and be spaced laterally from the center of the bottom thereof. The sub inlet 51 may be formed on one side of the sub guide 50. The one side may correspond to the position of the humidification reservoir 270 by which the humidification unit 10 generates mist. Owing to the sub inlet 51 formed on one side of the sub guide 50, the mist released from the discharge opening 320 may be sprayed off to one side of the discharge opening 320 corresponding to the one side.

The sub guide 50 may be sloped to guide upward the mist admitted through the sub inlet 51. The sub guide 50 may extend slantingly upward and laterally from the sub inlet 51. The sub inlet 51 may be positioned below the sub guide 50, and the sub guide 50 may extend slantingly downward toward the sub inlet 51. When the sub inlet 51 is formed on one side of the sub guide 50, the sub guide 50 may be sloped more steeply on one side than on the other side.

Thus, the mist admitted from the sub inlet may be distributed into the shell.

Moreover, the condensate present on the sub guide may move to the sub inlet along the sloping surface.

The holder rib 35 may guide the mist flowing from the sub guide 50. The holder rib 35 may control the flow of mist passing through it. The length extended by the holder rib 35 makes it possible to control the open area between the shell 40 and the holder rib 35. If the holder rib 35 is further extended, the distance between the holder rib 35 and the shell 40 may be shorter. If the holder rib 35 is less extended, the distance between the holder rib 35 and the shell 40 may be longer. By adjusting the length of the holder rib 35 extended to one side of the tank holder 30, the amount of mist passing through the one side of the tank holder 30 may be controlled.

The holder rib 35 may be further extended toward the sub inlet 51. One side of the holder rib 35 adjacent to the sub inlet 51 may be extended further than the other side of the holder rib 35. For example, a rear end of the holder rib 35 adjacent to the sub inlet 51 may be further extended, and be spaced inward from a sub peripheral wall 55 by a first distance. Also, a front end of the holder rib 35 may be less extended, and be spaced inward from the sub peripheral wall 55 by a second distance. The distance (first distance) by which the rear end of the holder rib 35 is spaced from the sub peripheral wall 55 may be shorter than the distance (second distance) by which the front end of the holder rib 35 is spaced from the sub peripheral wall 55. As such, the humidified air admitted through the sub inlet 51 may be distributed uniformly in all directions of the discharge flow path 310.

This helps keep the humidified air admitted to the sub guide through the outlet and the sub inlet from moving off to one side of the discharge flow path adjacent to the sub inlet.

Moreover, mist can be discharged uniformly from all points of the discharge opening.

In addition, any discomfort the user may feel can be lessened.

The rest of the air that has passed through the blower flow path 115 may ascend and move along the outer discharge flow path 117.

A blower grille 116 may be disposed between the outer discharge flow path 117 and the blower flow path 115. The blower grille 116 may prevent foreign matter from getting into the blower flow path 115.

A guide grille 60 may be disposed on the inner discharge flow path 310. Humidified air may swirl as it passes through the guide grille 60. For example, the guide grille 60 may impart a swirling motion to ascending humidified air.

Thus, humidified air may be uniformly mixed as it passes through the guide grille, and mist may be uniformly distributed across the discharge flow path.

The humidifier 1 may have a discharge opening 320 through which mist generated from the humidification unit 10 is discharged. Mist and air that have passed through the inner discharge flow path 310 may be discharged upward through the discharge opening 320. The inner discharge flow path 310 and the outer discharge flow path 117 may be joined together at the discharge opening 320.

The discharge opening 320 may be formed between the upper end of the tank holder 30 and the upper end of the shell 40. The discharge opening 320 may be formed between the tank cap 29 and the upper end of the shell 40.

The discharge opening 320 may have the shape of a loop. The discharge opening 320 may be formed between the tank holder 30 and the shell 40. For example, the center axis of the tank holder 30 may correspond in position to the center axis of the shell 40, and the discharge opening 320 may be formed in the shape of a loop between the upper end of the tank holder 30 and the upper end of the shell 40.

The discharge grille 330 may determine the direction in which humidified air is discharged through the discharge opening 320. The shape of the discharge grille 330 may correspond to the shape of the discharge opening 320. For example, the discharge opening 320 may have an annular shape, and the discharge grille 330 also may have an annular shape corresponding to the shape of the discharge opening 320.

The water stored in the tank 20 may enter the humidification unit 10 through a feeder 25.

The humidification unit 10 may include an inlet unit 210 for receiving water from the tank 20. The inlet unit 210 may correspond to the feeder 25. The humidification unit 10 may receive the water stored in the tank 20 through the inlet unit 210.

The humidification unit 10 may include a sub reservoir 220 for storing the water supplied from the tank 20. The inlet unit 210 may connect the tank 20 and the sub reservoir 220. The water stored in the sub reservoir 220 may flow out through a hole (not indicated by a reference numeral) formed through the bottom of the sub reservoir 220. The water that has flown out from the hole in the sub reservoir 220 may move to a heating reservoir 240. For example, the heating reservoir 240 may be positioned below the sub reservoir 220, so that water falling from the hole in the sub reservoir 220 may be stored in the heating reservoir 240.

The humidification unit 10 may include a heating reservoir 240 for sterilizing stored water. The heating reservoir 240 may heat stored water. The heating reservoir 240 may be fitted with a heater 242. The heater 242 may be disposed on the bottom of the heating reservoir 240, and may sterilize the water stored in the heating reservoir 240 by heating.

Therefore, mist can be supplied to an indoor space by using sterilized water.

Moreover, the sanitary performance of the humidifier can be improved.

The humidification unit 10 may include a floating valve 232 for regulating the outflow of water from the sub reservoir 220. The floating valve 232 may float. For example, the floating valve 232 may float on the surface of water stored in the heating reservoir 240 or in a valve guide 230 to be described later.

The vertical position of the floating valve 232 may be changed depending on the level of water stored in the heating reservoir 240. When the level of water stored in the heating reservoir 240 rises, the floating valve 232 may rise with it. When the level of water stored in the heating reservoir 240 drops, the floating valve 232 may descend.

The floating valve 232 may open or close the hole in the sub reservoir 220. When the floating valve 232 opens the hole in the sub reservoir 220, the water stored in the sub reservoir 220 may flow out to the heating reservoir 240. When the floating valve 232 closes the hole in the sub reservoir 220, the water stored in the sub reservoir 220 may not flow out.

The floating valve 232 may include a protrusion (not indicated by a reference numeral) to be inserted into the hole in the sub reservoir 220. The protrusion may protrude upward from the top of the floating valve 232. When the protrusion of the floating valve 232 is inserted into the hole of the sub reservoir 220, the hole in the sub reservoir 220 may be closed. When the protrusion of the floating valve 232 is taken out from the hole of the sub reservoir 220, the hole in the sub reservoir 220 may be opened.

The humidification unit 10 may include a valve guide 230 for guiding the movement of the floating valve 232. The valve guide 230 may have an internal space where the floating valve 232 moves. The internal space may extend vertically. The floating valve 232 may ascend or descend along the inner space of the vertically-extending valve guide 230. The bottom of the valve guide 230 may be penetrated. A through-hole in the valve guide 230 may communicate with the heating reservoir 240. When the water stored in the heating reservoir 240 rises to a given level, part of the water stored in the heating reservoir 240 may flow into the valve guide 230 through the through-hole. The water admitted into the valve guide 230 may cause the floating valve 232 to rise. When the water admitted into the valve guide 230 rises to a given level, the floating valve 232 may ascend and close the hole in the sub reservoir 220. When the water admitted into the valve guide 230 drops to a given level, the floating valve 232 may descend and open the hole in the sub reservoir 220.

The humidification unit 10 may include a connecting duct 250 that connects the heating reservoir 240 and the humidification reservoir 270. The water stored in the heating reservoir 240 may move to the humidification reservoir 270 through the connecting duct 250. Thus, the humidifier is able to humidify an indoor space by using sterilized water.

The humidification unit 10 may include a valve 251 for opening or closing the connecting duct (not shown). For example, the humidification unit 10 may include a solenoid valve 251 for opening or closing the connecting duct 250 by an electrical signal.

The connecting duct 250 may be slanted downward, from the heating reservoir 240 toward the humidification reservoir 270. With the connecting duct 250 which is slanted downward, downstream from its upstream position, the water stored in the heating reservoir 240 may move to the humidification reservoir 270. By means of the connecting duct 250, the water surface in the heating reservoir 240 and the water surface in the humidification reservoir 270 may correspond in position to each other.

Water heated by the heating reservoir 240 may decrease in temperature as it moves through the connecting duct 250. Air blown by the blower fan 112 may exchange heat with the heated water moving through the connecting duct 250. The heated water moving through the connecting duct 250 may drop in temperature due to the air blown by the blower fan 112. The temperature of the water admitted to the humidification reservoir 270 may be lower than the temperature of the water stored in the heating reservoir 240. When the heated water enters the humidification reservoir 270, it may cause a failure of the diaphragm 272. Thus, the temperature of the water heated in the heating reservoir 240 may be lowered before the water entres the humidification reservoir 270, thereby improving the life span of the diaphragm 272.

Therefore, the durability of the humidifier can be improved.

Moreover, a malfunction of the humidifier can be prevented.

The humidification unit 10 may include a steam pipe 260 for allowing the heating reservoir 240 and the humidification reservoir 270 to communicate with each other. The steam pipe 260 may be positioned above the heating reservoir 240. The steam pipe 260 may be positioned above the humidification reservoir 270. Steam generated from the heating reservoir 240 may pass through the steam pipe 260 and move to the humidification reservoir 270. The steam that has passed through the steam pipe 260 and moved to the humidification reservoir 270 may be condensed and stored in the humidification reservoir 270, or may be released directly from the humidification unit 10 as it is.

The humidification unit 10 may include a humidification reservoir 270 for generating mist. The water stored in the humidification reservoir 270 may be atomized into mist. The humidification unit 10 may include a diaphragm 272 disposed on the humidification reservoir 270. The diaphragm 272 may create mist by vibrating the water stored in the humidification reservoir 270. The diaphragm 272 may be disposed at the bottom of the humidification reservoir 270. A plurality of diaphragms 272 may be disposed at the bottom of the humidification reservoir 270.

The mist generated from the humidification reservoir 270 may be released from the humidification unit 10 through the outlet 290. The outlet 290 may be positioned above the humidification unit 10. The mist generated from the humidification reservoir 270 may pass through the outlet 290 and move to the inner discharge flow path 310.

The outlet 290 may be placed off to one side of the center of the discharge flow path 117 and 310. For example, the outlet 290 may be placed off to the right of the center. Since the outlet 290 is placed off to one side, the humidified air released from the outlet 290 may move off to one side.

The outlet 290 may extend vertically. The outlet 290 may be partially positioned inside the humidification reservoir 270. The outlet 290 may communicate with the sub inlet 51 of the sub guide 50. The outlet 290 may be open at the side and joined to the steam pipe 260. The steam generated from the heating reservoir 240 may pass through the steam pipe 260 and enter through the open side of the outlet 290 and combine with the mist generated from the humidification reservoir 270.

The bypass pipe 280 may be disposed on one side of the humidification reservoir 270. The bypass pipe 280 may guide the air flowing in the blower flow path 115 to the humidification reservoir 270. The air admitted to the humidification reservoir 270 by the bypass pipe 280 may be released to the outlet 290 along with the mist generated from the humidification reservoir 270. The air admitted through the bypass pipe 280 may be released to the outlet 290 along with the mist generated from the humidification reservoir 270 and/or the steam admitted from the heating reservoir 240 to the humidification reservoir 270 through the steam pipe 260.

An ultraviolet illuminator 274 may be disposed on an inner side of the humidification reservoir 270. The ultraviolet illuminator 274 may sterilize the water stored in the humidification reservoir 270 by illuminating it with ultraviolet light. Thus, the sterilization performance of the humidifier can be improved.

The humidifier 1 may include a sub guide 50 for guiding the steam released from the humidification unit 10. The sub guide 50 may guide the mist and/or air released from the outlet 290 to the inner discharge flow path 310.

The sub guide 50 may be disposed above the humidification reservoir 270. The sub guide 50 may be connected to the outlet 290. The sub guide 50 may be disposed below the tank holder 30. The sub guide 50 may be spaced downward from the tank holder 30. The mist released from the outlet 290 may move to a space between the sub guide 50 and the tank holder 30.

The sub guide 50 may be connected to the shell 40. The sub guide 50 may be connected to the peripheral wall of the shell 40. For example, the sub guide 50 may be connected to the inside of the peripheral wall of the inner shell 41, and the mist released from the outlet 290 may be guided to the inner side of the shell 40 by the sub guide 50.

The mist that has passed through the sub guide 50 may move along the inner discharge flow path 310 formed between the shell 40 and the tank holder 30. The shell 40 and/or the tank holder 30 may guide the movement of ascending mist.

The mist that has passed through the inner discharge flow path 310 may be emitted through the discharge opening 320 positioned at an upper end of the inner discharge flow path 310.

Figure 4:
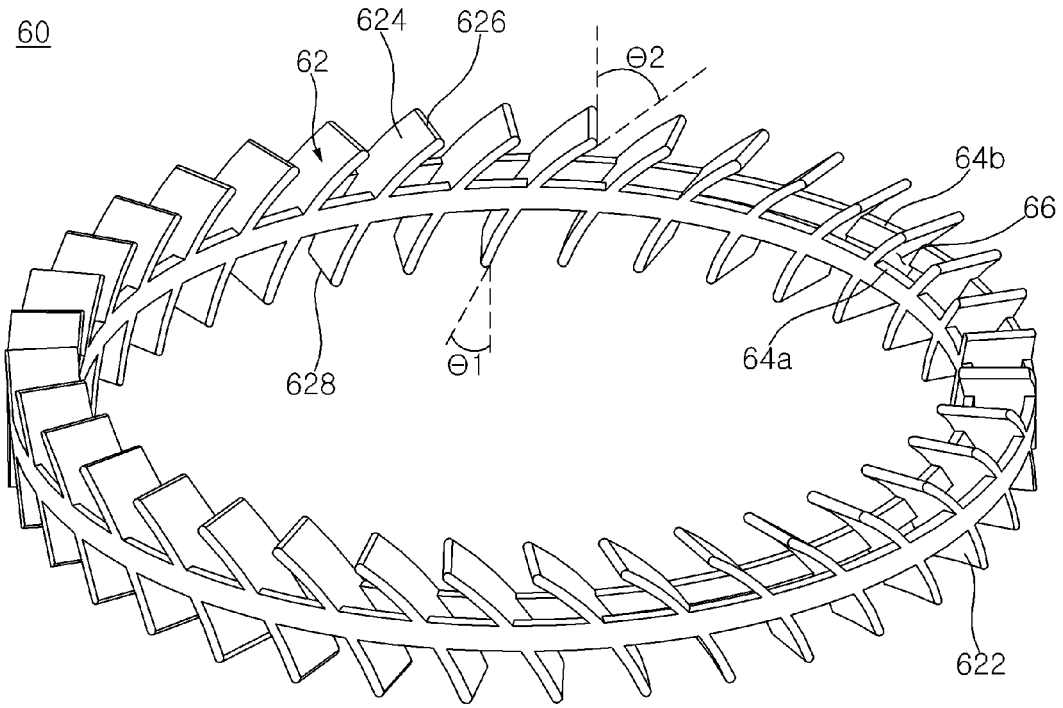
FIG. 4 is a perspective view of a guide grille according to an embodiment of the present disclosure.

Referring to FIG. 4, the guide grille 60 will be described.

The humidifier 1 may include a guide grille 60 disposed on the discharge flow path 310. The guide grille 60 may guide an airstream flowing through the discharge flow path 310. For example, the guide grille 60 may be disposed on the inner discharge flow path 310 and guide humidified air.

The guide grille 60 may cause an outgoing airstream to swirl. The guide grille 60 may guide an ascending outgoing airstream in such a way that it rises as it swirls in spirals. Since the ascending discharged airstream swirls as it rises, substances making up the outgoing airstream may be uniformly mixed. For example, since humidified air swirls as it rises, mist and an ascending airstream which constitute the humidified air may be uniformly mixed.

Moreover, the mist constituting the humidified air may be uniformly distributed in all directions of the inner discharge flow path 310.

In addition, the humidifier may perform humidification uniformly in all directions.

The guide grille 60 may be annular. The guide grille 60 may correspond to the discharge flow path 310. The annular guide grille 60 may be disposed on the discharge flow path 310 which has an annular cross-section.

The humidifier 1 includes a plurality of guide vanes 62 for guiding mist. The guide grille 60 may include a plurality of guide vanes 62. The plurality of guide vanes 62 may be arranged in a direction in which the guide grille 60 extends. For example, the plurality of guide vanes 62 may be circumferentially spaced apart from each other along the periphery of the annular guide grille 60.

An outgoing airstream may move between the plurality of guide vanes 62 which are spaced apart from each other. A guide flow path 66 may be formed between each of the guide vanes 62. The outgoing airstream may change the direction of flow of as it passes through the guide flow path 66. For example, the outgoing airstream may change the direction of flow from upward flow to spiral flow by means of the guide vanes 62 as it passes through the guide flow path 66.

The plurality of guide vanes 62 may be slanted from the vertical. Since the plurality of guide vanes 62 are slanted from the vertical, the direction of flow of the outgoing airstream may be changed from upward movement to spiral movement.

The plurality of guide vanes 62 may be slanted in a peripheral direction of the guide grille 60. The plurality of guide vanes 62 may be slanted in a circumferential direction. For example, the plurality of guide vanes 62 may be slanted in such a way that their upper end is turned clockwise, and an upper end of the plurality of guide vanes 62 may be spaced from a lower end thereof in a clockwise direction. The upper end of the guide vanes may be a rear end 626, and the lower end of the guide vanes may be a front end 628. Thus, the outgoing airstream may rise as it swirls clockwise while passing through the guide grille 60.

The plurality of guide vanes 62 may be formed to project upward. Since the guide vanes 62 are formed to project upward, the outgoing airstream may flow smoothly into the guide flow path 66. Moreover, the outgoing airstream may be more inclined to move in a circumferential direction after it has passed through the guide flow path 66.

The plurality of guide vanes 62 may include a front end 628 through which ascending mist is admitted and a rear end 626 through which ascending mist is discharged. The front end 628 may be an upstream side of the direction of flow of humidified air. The rear end 626 may be a downstream side of the direction of flow of humidified air. For example, the front end 628 of the guide vanes 62 may be a lower end, and the rear end 626 thereof may be an upper end. The angle (theta 2) at which the rear end 626 is slanted from the vertical may be larger than the angle (theta 1) at which the front end 628 is slanted from the vertical. Since the rear end 626 is more slanted laterally than the front end 628, the outgoing airstream may be able to swirl with greater force.

The inlet angle (theta 1) of the guide vanes 62 may be smaller than the outlet angle (theta 2) of the guide vanes. The inlet angle (theta 1) may be an angle at which ascending mist is admitted to the guide vanes 62. The outlet angle (theta 2) may be an angle at which ascending mist is discharged from the guide vanes 62. The inlet angle (theta 1) and the outlet angle (theta 2) may be measured with respect to the vertical.

A surface of the guide vanes 62 toward which air flows may be referred to as a constant pressure surface 622, and the opposite surface of the constant pressure surface 622 may be referred to as a negative pressure surface 624. For example, a surface of the guide vanes 62 facing downward is the constant pressure surface 622, and a surface thereof facing upward is the negative pressure surface 624.

The guide grille 60 may include a guide rim 62 that connects the plurality of guide vanes 62. The guide rim 64 may be annular. The guide rim 64 may include an inner guide rim **64*a* that forms an inner peripheral edge of the guide grille 60. The guide rim 64 may include an outer guide rim 64*b* that forms an outer peripheral edge of the guide grille 60. The inner guide rim 64*a* may come into contact with the tank holder 30. The outer guide rim 64*b* may come into contact with the inner shell 41**.

A guide flow path 66 may be formed between the inner guide rim **64*a* and the outer guide rim 64*b*. The plurality of guide vanes 62 may be disposed in a space between the inner guide rim 64*a* and the outer guide rim 64*b***.

Figure 5:
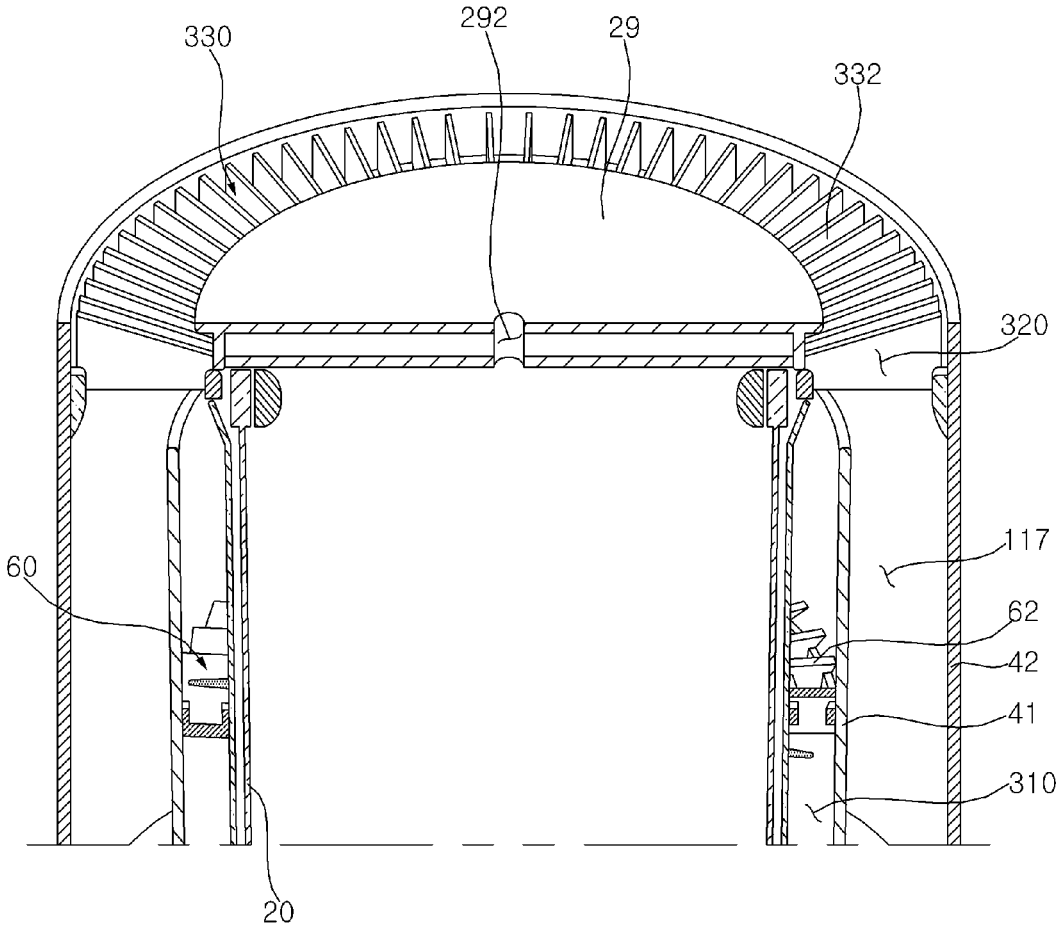
FIG. 5 is an enlarged view of the portion S1 in FIG. 2.

Referring to FIG. 5, the humidifier 1 will be described.

The inner shell 41 may divide the inner discharge flow path 310 and the outer discharge flow path 117. The inner discharge flow path 310 and the outer discharge flow path 117 may be joined together at the top of the inner shell 41. The discharge opening 320 may be positioned above the inner shell 41. The discharge opening 320 may be positioned at the upper ends of the inner discharge flow path 310 and outer discharge flow path 117.

The discharge opening 320 may be formed between the upper end of the tank 20 and the upper end of the outer shell 42. The discharge opening 320 may be formed between the tank cap 29 and the upper end of the outer shell 42. An annular discharge opening 320 may be formed between the cylindrical outer shell 42 and the cylindrical tank 20.

The plurality of guide vanes 62 may be disposed on the inner discharge flow path 310. The plurality of guide vanes 62 may be spaced apart from each other along the periphery of the inner discharge flow path 310. For example, the plurality of guide vanes 62 may be disposed along the periphery of an inner discharge flow path 310 having an annular cross-section.

The plurality of guide vanes 62 may be slanted in a peripheral direction of the inner discharge flow path 310. The periphery of the inner discharge flow path 310 may be circumferential. For example, the plurality of guide vanes 62 may be slanted in such a way that the rear end 626 is turned clockwise and the front end 628 is turned counterclockwise.

The guide rim 64 may extend around the periphery of the inner discharge flow path 310. For example, the guide rim 64 may have an annular shape that extends in a circumferential direction.

Figure 6:
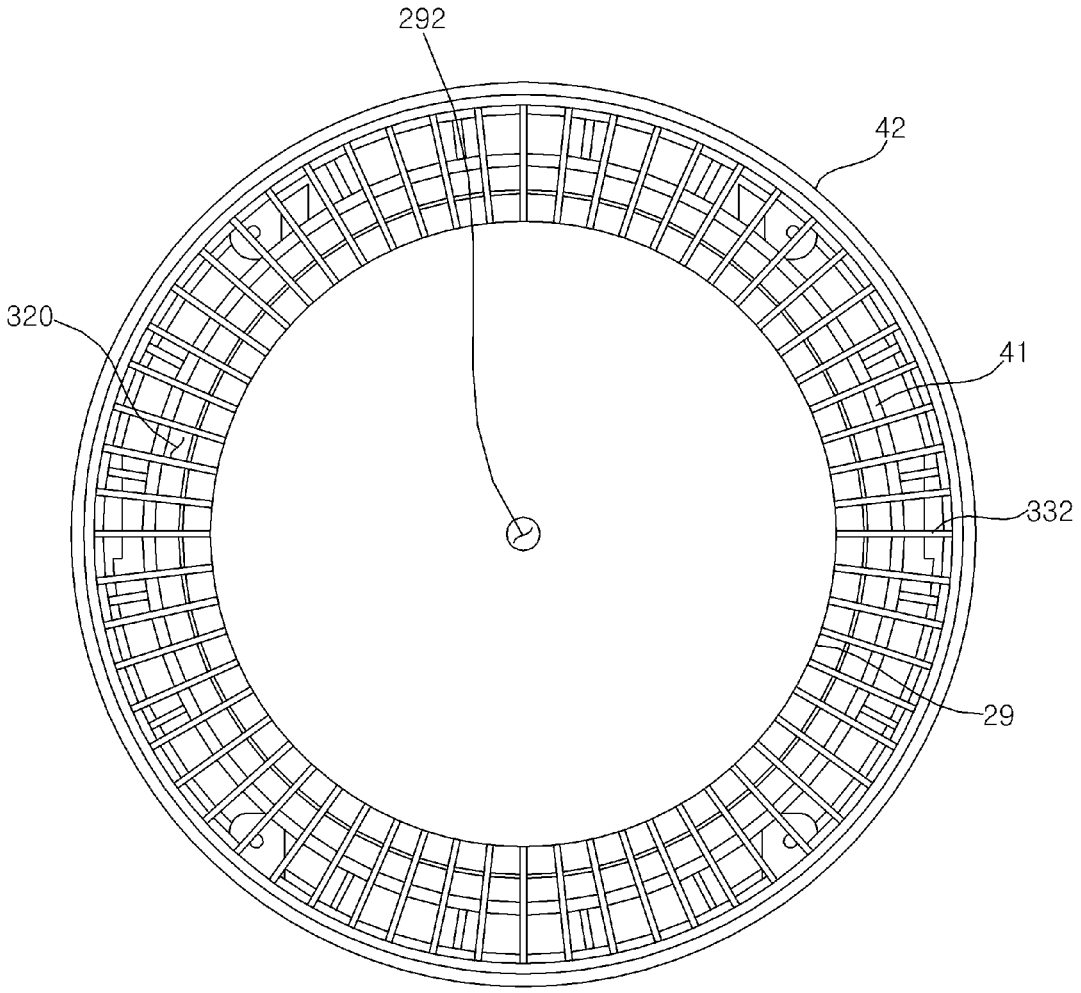
FIG. 6 is a plane view of a discharge grille according to an embodiment of the present disclosure.
Figure 7:
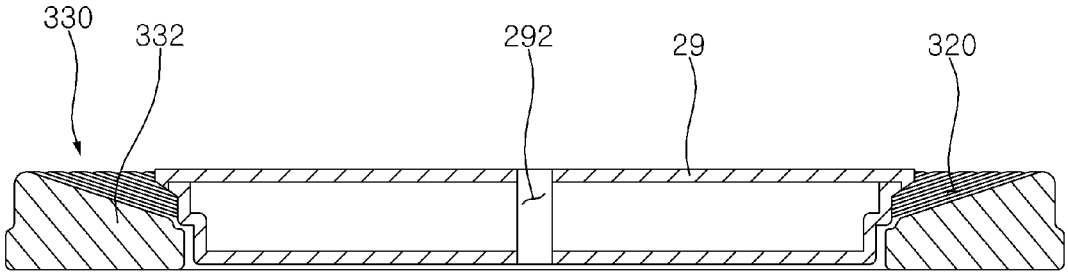
FIG. 7 is a cross-sectional view of a discharge grille according to an embodiment of the present disclosure.

Referring to FIGS. 6 and 7, the discharge grille 330 will be described.

The discharge grille 330 may be disposed on the discharge opening 320. The discharge grille 330 may form the top of the humidifier 1. The discharge grille 330 may form the top of the flow path body.

The discharge grille 330 may include a plurality of discharge vanes 332. The plurality of discharge vanes 332 may be spaced apart from each other along the periphery of the discharge grille 330. In this case, the discharge opening 320 may be formed between the plurality of discharge vanes 332.

The discharge vanes 332 may include a surface for guiding humidified air. The guide surface of the discharge vanes 32 may extend vertically.

The discharge vanes 332 may not be slanted. For example, the discharge vanes 332 may be arranged side by side vertically. Thus, the discharge vanes 332 may guide a discharge airstream to flow upward. Also, the discharge vanes 332 may transform a spirally ascending airstream blown from the guide grille 60 into a linearly ascending airstream.

Upper ends of the discharge vanes 332 may be slanted. For example, the upper ends of the discharge vanes 332, located downstream of a mist flow pathway, may be slanted downward and inward.

The distance between the plurality of discharge vanes 332 may become smaller toward the inside. Accordingly, the discharge vanes 332 arranged around the discharge opening 320 may be more narrowly spaced where a discharge airstream flowing through the inner discharge flow path 310 is discharged than where an outgoing airstream flowing through the outer discharge flow path 118 is discharged.

The tank cap 29 may be attached to or detached from the discharge grille 330. The tank cap 29 may be attached to or detached from the inner peripheral edge of the discharge grille 330. The plurality of discharge vanes 332 may be arranged around the outer periphery of the tank cap 29.

The tank cap 29 may have a drainage hole 292 for allowing the inside and outside of the tank 20 to communicate with each other. Condensate forming at the top of the tank cap 29 may collect in the tank 20 through the drainage hole 292. The drainage hole 292 may be formed vertically through the tank cap 29.

Figure 8:
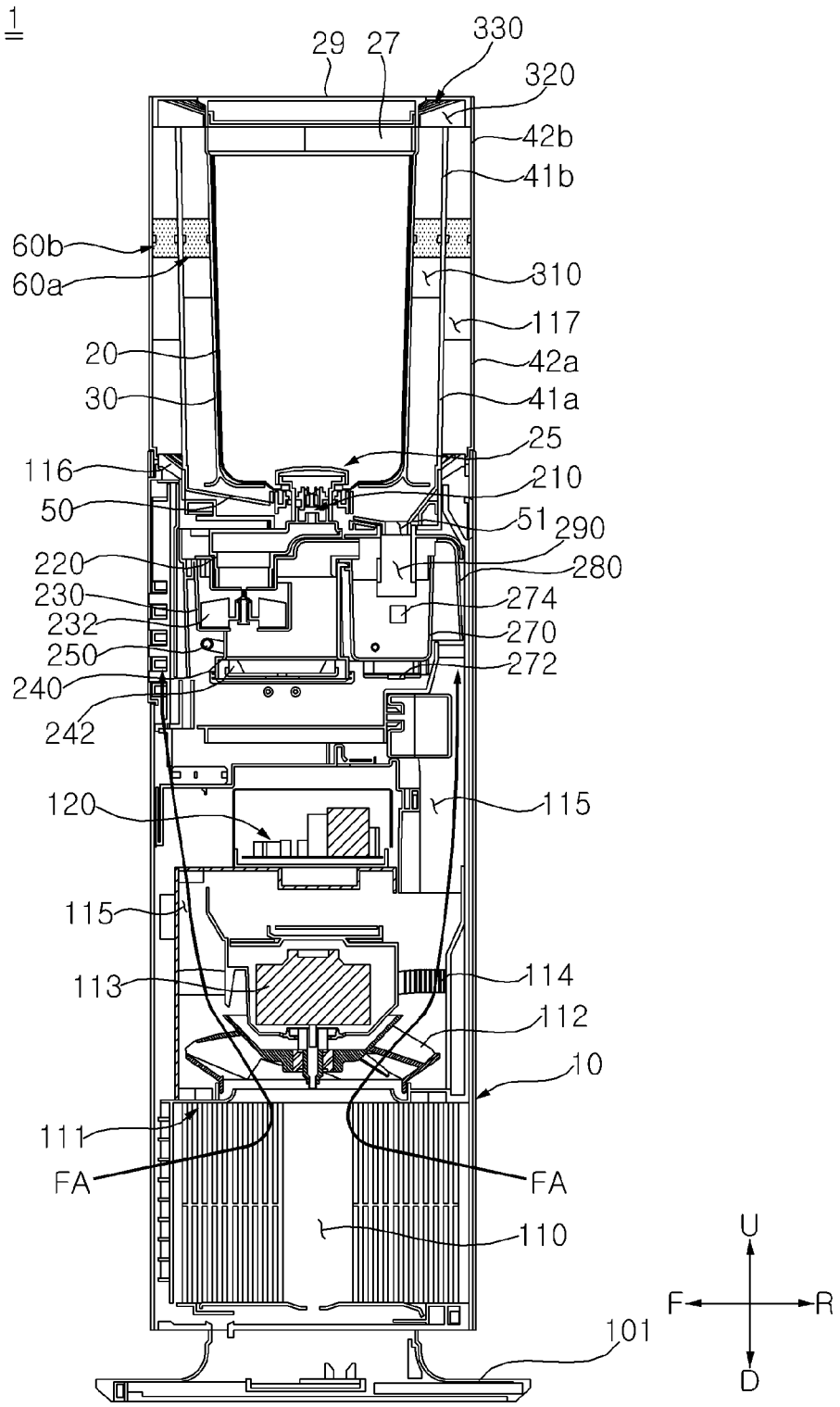
FIG. 8 is a cross-sectional view of a humidifier according to another embodiment of the present disclosure.

Referring to FIG. 8, the humidifier 1 will be described.

The guide grille 60 may include an inner guide grille 60*a* disposed on the inner discharge flow path 310. The inner guide grille 60*a* may impart a swirling motion to an outgoing airstream flowing through the inner discharge flow path 310.

The plurality of guide vanes 62 may include a plurality of inner guide vanes 62*a* disposed on the inner discharge flow path 310.

The guide grille 60 may include an outer guide grille 60*b* disposed on the outer discharge flow path 117. The outer guide grille 60*b* may impart a swirling motion to an outgoing airstream flowing through the outer discharge flow path 117.

The plurality of guide vanes 62 may include a plurality of outer guide vanes 62*b* disposed on the outer discharge flow path 117.

Referring to FIGS. 1 to 8, a humidifier according to one aspect of the present disclosure includes: a humidification unit for generating mist; a flow path body disposed above the humidification unit, that has a discharge flow path having an annular cross-section through which mist released from the humidification unit flows; and a plurality of guide vanes disposed on the discharge flow path, slanted from the vertical, wherein the plurality of guide vanes may be spaced apart from each other along the periphery of the discharge flow path.

According to another aspect of the present disclosure, the humidification unit may have an outlet through which generated mist is released, wherein the outlet may be placed off to one side of the center of the discharge flow path.

According to another aspect of the present disclosure, the flow path body may further comprise: a tank with an open top, for storing water; and a shell spaced outward from the outer periphery of the tank, wherein the discharge flow path may be formed between the tank and the shell and communicate with the outlet.

According to another aspect of the present disclosure, the shell may include: an inner shell spaced outward from the outer periphery of the tank; and an outer shell spaced outward from the outer periphery of the inner shell, the discharge flow path may include: an inner discharge flow path formed between the tank and the inner shell; and an outer discharge flow path formed between the inner shell and the outer shell, the outlet may communicate with the inner discharge flow path, and the plurality of guide vanes may include a plurality of inner guide vanes disposed on the inner discharge flow path.

According to another aspect of the present disclosure, the humidification unit has a blower flow path whose cross-section is annular along the inner periphery of the humidification unit, and which communicates with the outer discharge flow path, and includes a humidification reservoir with an open top, for generating mist and a bypass pipe for guiding an airstream flowing through the blower flow path to the humidification unit, wherein the bypass pipe may be disposed on one side of the blower flow path, between the inner periphery of the humidification unit and the humidification reservoir, and the plurality of guide vanes may include a plurality of outer guide vanes disposed on the outer discharge flow path.

According to another aspect of the present disclosure, the inner discharge flow path and the outer discharge flow path may be joined together at an upper end of the inner shell.

According to another aspect of the present disclosure, the humidifier may include a guide grille disposed on the discharge flow path, wherein the guide grille may include: the plurality of guide vanes; and a guide rim that extends around the periphery of the discharge flow path and connects the plurality of guide vanes.

According to another aspect of the present disclosure, the plurality of guide vanes may be formed to project upward.

According to another aspect of the present disclosure, the plurality of guide vanes may include: a front end through which ascending mist is admitted; and a rear end through which ascending mist is discharged, wherein the angle at which the rear end is slanted from the vertical may be larger than the angle at which the front end is slanted from the vertical.

According to another aspect of the present disclosure, the humidifier may include an annular discharge grille disposed on the discharge flow path and having a plurality of discharge vanes, wherein the plurality of discharge vanes may be spaced apart from each other along the periphery of the discharge grille, and a discharge opening communicating with the discharge flow path may be formed between the plurality of discharge vanes.

According to another aspect of the present disclosure, the discharge grille may be spaced upward from the plurality of guide vanes.

According to another aspect of the present disclosure, the plurality of discharge vanes may extend vertically.

According to another aspect of the present disclosure, upper ends of the plurality of discharge vanes may be slanted downward and inward.

According to another aspect of the present disclosure, the flow path body may include: a tank with an open top, for storing water; a tank holder into which the tank is inserted, and which covers the outer periphery of the tank; and a shell spaced outward from the outer periphery of the tank holder, wherein the discharge flow path may be formed between the tank holder and the shell, and the tank holder may have a holder rib protruding outward from the outer periphery and spaced inward from the inner periphery of the shell.

According to another aspect of the present disclosure, the distance between the holder rib and the shell may become smaller toward the outlet.

Referring to FIGS. 1 to 8, a humidifier according to one aspect of the present disclosure includes: a humidification unit for generating mist; a flow path body disposed above the humidification unit, that has a discharge flow path having an annular cross-section through which mist released from the humidification unit flows; and a plurality of guide vanes disposed on the discharge flow path, for guiding mist, wherein the plurality of guide vanes may be spaced apart from each other along the periphery of the discharge flow path, and an inlet angle at which ascending mist is admitted to the plurality of guide vanes may be smaller than an outlet angle at which mist is discharged from the plurality of guide vanes.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

The detailed description thereof should not be construed as restrictive in all aspects but considered as illustrative. The scope of the present disclosure should be determined by reasonable interpretation of the appended claims and all changes that come within the equivalent scope of the invention are included in the scope of the present disclosure.

LIST OF REFERENCE NUMERALS

1: Humidifier
10: Humidification unit
11: Intake opening
20: Tank
29: Tank cap
30: Tank holder
35: Holder rib
40: Shell
41: Inner shell
42: Outer shell
117: Outer discharge flow path
270: Humidification reservoir
280: Bypass pipe
290: Outlet
310: Inner discharge flow path
320: Discharge opening
330: Discharge grille

What is claimed is:

1. A humidifier comprising:
a humidification unit generating mist;
a flow path body disposed above the humidification unit and that has a discharge flow path having an annular cross-section through which mist emitted from the humidification unit flows; and
a plurality of guide vanes disposed on the discharge flow path,
wherein the plurality of guide vanes are spaced apart from each other along the periphery of the discharge flow path,
wherein the discharge flow path includes:
an inner discharge flow path formed on an inside; and
an outer discharge flow path formed on an outside; and
wherein the plurality of guide vanes comprise a plurality of inner guide vanes disposed on the inner discharge flow path.

2. The humidifier of claim 1,
wherein the humidification unit has an outlet from which generated mist is emitted,
wherein the outlet is placed off to one side of the center of the discharge flow path.

3. The humidifier of claim 2,
wherein the flow path body further comprises:
a tank having open top, and storing water; and
a shell spaced outward from the outer periphery of the tank, and
wherein the discharge flow path is formed between the tank and the shell and communicates with the outlet.

4. The humidifier of claim 3, wherein the shell comprises:
an inner shell spaced outward from the outer periphery of the tank; and
an outer shell spaced outward from the outer periphery of the inner shell,
wherein the inner discharge flow path is formed between the tank and the inner shell; and the outer discharge flow path is formed between the inner shell and the outer shell,
wherein the outlet communicates with the inner discharge flow path, and
wherein the plurality of guide vanes are slanted from vertical.

5. The humidifier of claim 4, wherein the humidification unit comprises:
a blower flow path whose cross-section is annular along the inner periphery of the humidification unit, and which communicates with the outer discharge flow path;
a humidification reservoir having an open top, and generating mist; and
a bypass pipe for guiding an airstream flowing through the blower flow path to the humidification reservoir,
wherein the bypass pipe is disposed on one side of the blower flow path, between the inner periphery of the humidification unit and the humidification reservoir, and
wherein the plurality of guide vanes include a plurality of outer guide vanes disposed on the outer discharge flow path.

6. The humidifier of claim 4, wherein the inner discharge flow path and the outer discharge flow path are merged together at an upper end of the inner shell.

7. The humidifier of claim 1, further comprising:
a guide grille disposed on the discharge flow path, and
wherein the guide grille comprises:
the plurality of guide vanes; and
a guide rim that extends along the periphery of the discharge flow path and connects the plurality of guide vanes.

8. The humidifier of claim 1, wherein the plurality of guide vanes are convex upward.

9. The humidifier of claim 1, wherein the plurality of guide vanes comprise:
a front end receiving ascending mist; and
a rear end discharging ascending mist, and
wherein an angle at which the rear end is slanted from vertical is larger than an angle at which the front end is slanted from vertical.

10. The humidifier of claim 1, further comprising:

an annular discharge grille disposed on the discharge flow path and having a plurality of discharge vanes, wherein the plurality of discharge vanes are spaced apart from each other along the periphery of the discharge grille, and wherein a discharge opening communicating with the discharge flow path is formed between the plurality of discharge vanes.

11. The humidifier of claim 10, wherein the discharge grille is spaced upward from the plurality of guide vanes.

12. The humidifier of claim 10, wherein the plurality of discharge vanes are extended vertically.

13. The humidifier of claim 10, wherein upper ends of the plurality of discharge vanes are slanted downward and inward.

14. The humidifier of claim 2, wherein the flow path body comprises:

a tank having an open top, and storing water;

a tank holder into which the tank is inserted, and which covers the outer periphery of the tank; and a shell spaced outward from the outer periphery of the tank holder, wherein the discharge flow path is formed between the tank holder and the shell, and wherein the tank holder comprises a holder rib protruding outward from the outer periphery and spaced inward from the inner periphery of the shell.

15. The humidifier of claim 14, wherein the distance between the holder rib and the shell becomes smaller toward the outlet.

16. A humidifier comprising:

a humidification unit for generating mist;

a flow path body disposed above the humidification unit, that has a discharge flow path having an annular cross-section through which mist emitted from the humidification unit flows; and a plurality of guide vanes disposed on the discharge flow path, and guiding mist, wherein the plurality of guide vanes are spaced apart from each other along the periphery of the discharge flow path, and wherein an inlet angle at which ascending mist flows into the plurality of guide vanes is smaller than an outlet angle at which mist is discharged from the plurality of guide vanes.

* * * * *